US012331374B2

(12) United States Patent
Kohsaka et al.

(10) Patent No.: US 12,331,374 B2
(45) Date of Patent: Jun. 17, 2025

(54) THIN STEEL SHEET AND METHOD FOR MANUFACTURING SAME

(71) Applicant: JFE Steel Corporation, Tokyo (JP)

(72) Inventors: Noriaki Kohsaka, Tokyo (JP); Shinjiro Kaneko, Tokyo (JP); Akinori Nakamura, Tokyo (JP); Yuma Honda, Tokyo (JP); Tadachika Chiba, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 921 days.

(21) Appl. No.: 17/284,534

(22) PCT Filed: Oct. 15, 2019

(86) PCT No.: PCT/JP2019/040397

§ 371 (c)(1),
(2) Date: Apr. 12, 2021

(87) PCT Pub. No.: WO2020/080337

PCT Pub. Date: Apr. 23, 2020

(65) Prior Publication Data

US 2021/0381076 A1 Dec. 9, 2021

(30) Foreign Application Priority Data

Oct. 17, 2018 (JP) ..... 2018-195601

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
USPC ..... 148/652
See application file for complete search history.

(56) References Cited

U.S. PATENT DOCUMENTS

2015/0000796 A1 1/2015 Kakiuchi et al.
2016/0369369 A1 12/2016 Takashima et al.
(Continued)

FOREIGN PATENT DOCUMENTS

CN 102333901 A 1/2012
CN 102449180 A 5/2012
(Continued)

OTHER PUBLICATIONS

International Search Report and Written Opinion for International Application No. PCT/JP2019/040397, dated Jan. 7, 2020, 6 pages. 2021.
(Continued)

*Primary Examiner* — Brian D Walck
(74) *Attorney, Agent, or Firm* — Buchanan Ingersoll & Rooney PC

(57) ABSTRACT

A thin steel sheet has a specific chemical composition. The thin steel sheet has a microstructure in which ferrite is present in an area fraction of 5% or more and 60% or less, as-quenched martensite is present in an area fraction of 10% or less (including 0%), retained austenite is present in an area fraction of 5% or more and 20% or less, and upper bainite, lower bainite, and tempered martensite are present in a total area fraction of more than 15% and less than 85%; BCC iron that has a misorientation of 1° or less and surrounds retained austenite having an aspect ratio of 2.5 or higher is present in an area fraction of 5% or more and 70% or less; and a top 10% of retained austenite in terms of an equivalent circular diameter has an average aspect ratio of 2.5 or higher.

4 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/42*** | (2006.01) |
| ***C22C 38/58*** | (2006.01) |

(52) U.S. Cl.

CPC ..... *C21D 8/0205* (2013.01); *C21D 8/0236* (2013.01); *C22C 38/001* (2013.01); *C22C 38/002* (2013.01); *C22C 38/005* (2013.01); *C22C 38/02* (2013.01); *C22C 38/06* (2013.01); *C22C 38/12* (2013.01); *C22C 38/14* (2013.01); *C22C 38/42* (2013.01); *C22C 38/58* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2017/0107591 | A1 | 4/2017 | Takashima et al. |
| 2017/0145634 | A1 | 5/2017 | Takashima et al. |
| 2019/0071757 | A1 | 5/2019 | Murata et al. |
| 2020/0157647 | A1* | 5/2020 | Ono ..... C22C 38/04 |

FOREIGN PATENT DOCUMENTS

| | | | |
|---|---|---|---|
| EP | 2402470 | A1 | 1/2012 |
| EP | 2436794 | A1 | 4/2012 |
| EP | 3412786 | A1 | 12/2018 |
| EP | 3611285 | A1 | 2/2020 |
| JP | 2013181184 | A | 9/2013 |
| JP | 2014218692 | A | 11/2014 |
| JP | 2016050343 | A | 4/2016 |
| JP | 2017155327 | A | 9/2017 |
| JP | 2017186647 | A | 10/2017 |
| JP | 2017214647 | A | 12/2017 |
| JP | 2017214648 | A | 12/2017 |
| WO | 2015115059 | A1 | 8/2015 |
| WO | 2015151419 | A1 | 10/2015 |
| WO | 2015151427 | A1 | 10/2015 |
| WO | 2018055425 | A1 | 3/2018 |

OTHER PUBLICATIONS

Kodym et al., Autorenokollektiv: "Spurenelements im Stahl—Meoglichkeiten zur Beeinflussung im Smelzbetrieb" Trace Elements in Steel—Possibilites for Influencing the Smelting Operation, 1985, 1 page.

Extended European Search Report for European Application No. 19874610.9, dated Jul. 22, 2021, 10 pages.

Chinese Office Action for Chinese Application No. 201980067611.9, dated Dec. 1, 2021 with Concise Statement of Relevance of Office Action, 8 pages.

European Communication pursuant to Article 94(3) for European Application No. 19 874 610.9, dated Mar. 1, 2023, 5 pages.

* cited by examiner

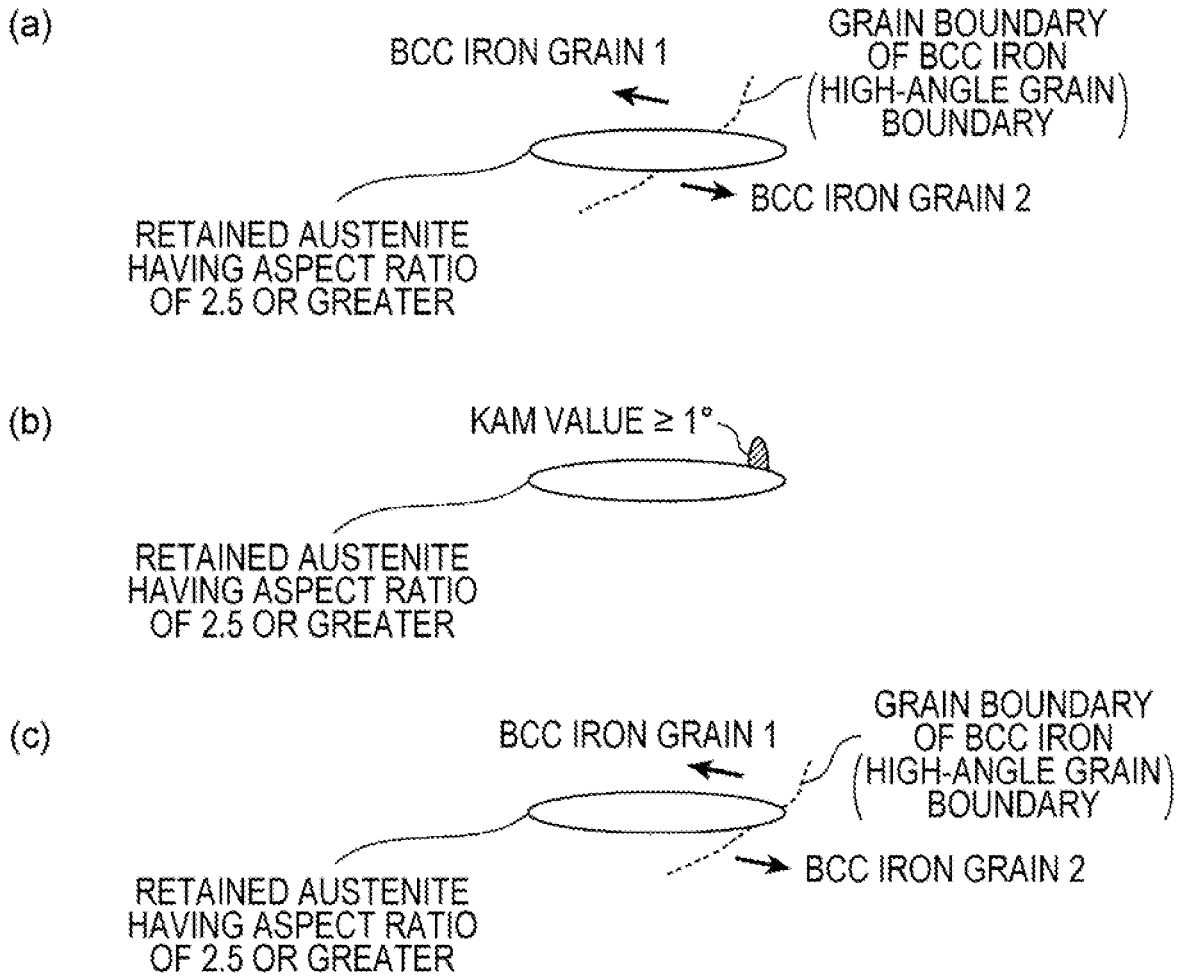
(a)
BCC IRON GRAIN 1
GRAIN BOUNDARY OF BCC IRON (HIGH-ANGLE GRAIN BOUNDARY)
BCC IRON GRAIN 2
RETAINED AUSTENITE HAVING ASPECT RATIO OF 2.5 OR GREATER
(b)
KAM VALUE ≥ 1°
RETAINED AUSTENITE HAVING ASPECT RATIO OF 2.5 OR GREATER
(c)
BCC IRON GRAIN 1
GRAIN BOUNDARY OF BCC IRON (HIGH-ANGLE GRAIN BOUNDARY)
BCC IRON GRAIN 2
RETAINED AUSTENITE HAVING ASPECT RATIO OF 2.5 OR GREATER

THIN STEEL SHEET AND METHOD FOR MANUFACTURING SAME

CROSS REFERENCE TO RELATED APPLICATIONS

This is the U.S. National Phase application of PCT/JP2019/040397, filed Oct. 15, 2019, which claims priority to Japanese Patent Application No. 2018-195601, filed Oct. 17, 2018, the disclosures of these applications being incorporated herein by reference in their entireties for all purposes.

FIELD OF THE INVENTION

The present invention relates to a thin steel sheet and a method for manufacturing the same. The thin steel sheet according to aspects of the present invention has a strength of 590 MPa or higher in terms of tensile strength (TS) and has excellent stretch formability and bendability. Accordingly, the thin steel sheet according to aspects of the present invention is suitable as a material for an automotive frame member.

BACKGROUND OF THE INVENTION

In recent years, from the standpoint of global environmental protection, in the entire automobile industry, there is a trend toward improving the fuel efficiency of automobiles to limit $CO_2$ emission. The most effective way to improve the fuel efficiency of automobiles is to reduce the weight of automobiles by using thinner components, and, therefore, in recent years, the volume of high-strength steel sheets used as a material for automotive components has been increasing.

In general, there is a tendency that the formability of a steel sheet decreases with an increase in strength thereof, and, therefore, further expanding the widespread use of high-strength steel sheets requires improving formability. As a technique for improving formability, various technologies regarding a TRIP steel sheet, which utilizes retained austenite, have been known in the past.

For example, Patent Literature 1 states that a 1180 MPa or higher steel sheet that has excellent elongation and stretch flange formability and has a high yield ratio can be obtained; this is achieved because the steel sheet contains ferrite having an average crystal grain diameter of 3 μm or less and a volume fraction of 5% or less, retained austenite having a volume fraction of 10% or more and 20% or less, and martensite having an average crystal grain diameter of 4 μm or less and a volume fraction of 20% or less, with the balance including bainite and/or tempered martensite, and, in the steel sheet, cementite grains having a grain diameter of 0.1 μm or more are precipitated, with an average number of the cementite grains per 100 $\mu m^2$ in a cross section in the thickness direction parallel to the rolling direction of the steel sheet being 30 or more.

Patent Literature 2 and Patent Literature 3 each state that a steel sheet having excellent elongation, hole expandability, and deep drawability can be obtained; this is achieved because a ferrite fraction is 5% or less, or, a ferrite fraction is more than 5% and 50% or less, and an amount of retained austenite is 10% or more, and in addition, MA, which is a composite structure formed of retained austenite and martensite, is refined, and retained austenite having a size of 1.5 μm or larger is increased.

PATENT LITERATURE

PTL 1: International Publication No. WO2015-115059
PTL 2: Japanese Unexamined Patent Application Publication No. 2017-214648
PTL 3: Japanese Unexamined Patent Application Publication No. 2017-214647

SUMMARY OF THE INVENTION

It is stated that in the technology proposed in Patent Literature 1, if cementite were not precipitated, a hardness of tempered martensite and bainite would increase, which would result in degraded stretch flange formability. That is, a strength and formability of a steel sheet necessarily vary with the state of precipitation of cementite, and, therefore, it is impossible to obtain a steel sheet having stable mechanical properties.

It is stated that in the technologies proposed in Patent Literature 2 and 3, if a carbon-rich region were too large, MA would be coarse, which would result in a reduction in hole expandability and a reduced hole expansion ratio. In TRIP steel, with an increase in an amount of carbon enrichment in retained austenite, ductility increases; however, a problem has been encountered in that it has been impossible to maximally obtain the effect of TRIP because it has been also desired to achieve a stretch flange formability.

A high-strength steel sheet having excellent formability as proposed in accordance with aspects of the present invention is not found in any of the patent literature, and, accordingly, objects according to aspects of the present invention are to provide a thin steel sheet having a tensile strength of 590 MPa or higher and good formability and to provide a method for manufacturing the same.

To achieve the objects described above, the present inventors diligently performed studies regarding requirements for achieving both a stretch formability and a bendability in a TRIP steel sheet. Thin steel sheets with which aspects of the present invention are concerned have a sheet thickness of 0.4 mm or more and 2.6 mm or less. In TRIP steel sheets, elongation is improved by utilizing retained austenite, but, in bending, since a high strain is imparted to a surface, retained austenite therein is transformed into martensite as a result of the effect of TRIP; because of the martensite, achieving excellent bendability has been difficult.

In many inventions to date, bendability was improved by using hard tempered martensite or bainite as a matrix constituent, thereby reducing the difference in hardness between the matrix constituent and the martensite transformed by the effect of TRIP. However, hard phases have low ductility, and, as described above, the effect of TRIP was not maximally utilized because much importance was placed on bendability. In view of this, the countermeasure in the past that placed importance on tempered martensite and bainite, which was a countermeasure commonly used for TRIP steel sheets, was discarded, and a detailed investigation was conducted to find an optimal structural construction and its form; accordingly, diligent studies were performed to develop a heat treatment method for obtaining such a structure.

First, to enhance bendability without compromising the effect of TRIP, the retained austenite is to be modified to have a shape having a high aspect ratio, and in addition, the retained austenite is to be surrounded by BCC iron having small crystal structure disturbance. As a result, martensitic-transformation-induced damage on a surface which is subjected to bending is inhibited, and, therefore, bendability is improved. This is a finding that was made. It was discovered that for surrounding retained austenite having a high aspect ratio with BCC iron having small crystal structure disturbance, it is important to promote localization of carbon in a process of heating and subsequent cooling and then perform holding in a temperature range of 400° C. or higher and 520° C. or lower. Aspects of the present invention were completed based on these findings, and a summary thereof is as follows.

[1] A thin steel sheet which comprises: a chemical composition containing, in mass %, C: 0.08% or more and 0.24% or less, Si: 0.70% or more and 2.20% or less, Mn: 0.8% or more and 3.4% or less, P: 0.05% or less, S: 0.005% or less, Al: 0.005% or more and 0.70% or less, and N: 0.0060% or less, the balance being Fe and incidental impurities; and a microstructure including ferrite in an area fraction of 5% or more and 60% or less, as-quenched martensite in an area fraction of 10% or less (including 0%), retained austenite in an area fraction of 5% or more and 20% or less, and upper bainite, lower bainite, and tempered martensite in a total area fraction of more than 15% and less than 85%, wherein BCC iron having a misorientation of 1° or less and surrounds retained austenite having an aspect ratio of 2.5 or higher is present in an area fraction of 5% or more and 70% or less, and a top 10% of retained austenite in terms of an equivalent circular diameter, of all retained austenite surrounded by BCC iron having a misorientation of 1° or less, has an average aspect ratio of 2.5 or higher.

[2] The thin steel sheet according to [1], wherein the chemical composition further contains, in mass %, one or more of Ti: 0.001% or more and 0.2% or less, Nb: 0.001% or more and 0.2% or less, V: 0.001% or more and 0.5% or less, Cu: 0.001% or more and 0.5% or less, Ni: 0.01% or more and 0.5% or less, Cr: 0.001% or more and 1.0% or less, and B: 0.0002% or more and 0.0050% or less.

[3] The thin steel sheet according to [1] or [2], wherein the chemical composition further contains, in mass %, one or more of Mo: 0.001% or more and 1.0% or less, Sb: 0.001% or more and 0.050% or less, REM: 0.0002% or more and 0.050% or less, Mg: 0.0002% or more and 0.050% or less, and Ca: 0.0002% or more and 0.050% or less.

[4] A method for manufacturing a thin steel sheet which comprises: cold rolling a hot-rolled steel sheet having the chemical composition according to any one of [1] to [3] with a rolling reduction ratio of 46% or higher; and annealing the cold-rolled steel sheet including, after the cold rolling: heating the cold-rolled steel sheet to a temperature of 780° C. or higher and 845° C. or lower; cooling the cold-rolled steel sheet with an average cooling rate from 740° C. to 600° C. of 8° C./s or higher and 25° C./or less to a temperature range of 400° C. or higher and 520° C. or lower; holding the cold-rolled steel sheet at the temperature range for 10 seconds or more and 80 seconds or less; cooling the cold-rolled steel sheet with an average cooling rate from 400° C. to 300° C. of 8° C./s or higher to a cooling stop temperature of 150° C. or higher and 300° C. or lower; holding the cold-rolled steel sheet in a temperature range within ±50° C. of the cooling stop temperature for 2 seconds or more and 25 seconds or less; and heating the cold-rolled steel sheet to a temperature range of 300° C. or higher and 500° C. or lower and, subsequently, holding the cold-rolled steel sheet in the temperature range for 480 seconds or more and 1400 seconds or less.

According to aspects of the present invention, thin steel sheets according to aspects of the present invention have a high strength of 590 MPa or higher in terms of tensile strength (TS) and have excellent formability. In instances in which a thin steel sheet according to aspects of the present invention is used in an automotive component, a further weight reduction in automotive components is realized.

BRIEF DESCRIPTION OF THE DRAWINGS

FIGS. 1(*a*) to 1(*c*) are schematic diagrams for explaining the definition of BCC iron that surrounds retained austenite having an aspect ratio of 2.5 or higher as defined in accordance with aspects of the present invention.

DETAILED DESCRIPTION OF EMBODIMENTS OF THE INVENTION

Embodiments of the present invention will be described below. Note that the present invention is not limited to the embodiments described below.

A chemical composition and a microstructure of a thin steel sheet according to aspects of the present invention will be described in this order.

The chemical composition of the thin steel sheet contains, in mass %, C: 0.08% or more and 0.24% or less, Si: 0.70% or more and 2.20% or less, Mn: 0.8% or more and 3.4% or less, P: 0.05% or less, S: 0.005% or less, Al: 0.005% or more and 0.70% or less, and N: 0.0060% or less, with these ranges being satisfied. Each of the components will be described below. In the following description, "%" representing a content of a component means "mass %".

C: 0.08% or More and 0.24% or Less

C contributes to increasing the strength of steel sheets and, in addition, has an effect of increasing the stability of retained austenite, thereby increasing ductility. Achieving the characteristics desired in accordance with aspects of the present invention requires the presence of C in an amount more than or equal to 0.08%. Preferably, the amount is more than or equal to 0.09%. On the other hand, if C content is more than 0.24%, hardenability is too high, and, therefore, BCC iron having small crystal structure disturbance, which is desired in accordance with aspects of the present invention, is not obtained. Accordingly, C content is specified to be in a range of less than or equal to 0.24%. Desirably, C content is less than or equal to 0.23%.

Si: 0.70% or More and 2.20% or Less

Si is an element effective for increasing elongation of steel sheets and inhibiting precipitation of cementite, thereby obtaining retained austenite. Achieving a desired stretch formability and a desired amount of retained austenite requires the presence of Si in an amount at least more than or equal to 0.70%. Preferably, the amount is more than or equal to 0.80%. On the other hand, if Si is present in an amount more than 2.20%, chemical conversion properties are degraded, and, therefore, suitability for forming automotive members is lost. Accordingly, Si content is specified to be less than or equal to 2.20%. Preferably, Si content is less than or equal to 2.10%.

Mn: 0.8% or More and 3.4% or Less

Mn is an austenite-stabilizing element. Achieving a desired area fraction of ferrite and a desired area fraction of retained austenite requires the presence of Mn in an amount more than or equal to 0.8%. Preferably, the amount is more than or equal to 1.2%. On the other hand, if Mn is present in an excessive amount, hardenability is too high, and, therefore, BCC iron having small crystal structure disturbance is not obtained. Accordingly, Mn content is specified to be less than or equal to 3.4%. Preferably, Mn content is less than or equal to 3.2%.

P: 0.05% or Less

P is a harmful element because P causes low-temperature brittleness and reduces weldability. Accordingly, it is preferable that an amount of P be reduced as much as possible. In accordance with aspects of the present invention, P content of up to 0.05% is permissible. Preferably, P content is less than or equal to 0.02%. For usage under more severe welding conditions, it is more preferable that P content be limited to less than or equal to 0.01%. On the other hand, P may be unintentionally incorporated in an amount of up to 0.002% in the manufacturing.

S: 0.005% or Less

S forms coarse sulfides in steel, and such sulfides are elongated during hot rolling and form wedge-shaped inclusions. As such, S adversely affects weldability. Thus, S is also a harmful element, and, therefore, it is preferable that an amount of S be reduced as much as possible. In accordance with aspects of the present invention, S content of up to 0.005% is permissible, and, accordingly, S content is specified to be less than or equal to 0.005%. Preferably, S content is less than or equal to 0.003%. For usage under more severe welding conditions, it is more preferable that S content be limited to less than or equal to 0.001%. S may be unintentionally incorporated in an amount of up to 0.0002% in the manufacturing.

Al: 0.005% or More and 0.70% or Less

In instances in which Al is added as a deoxidizing agent at the stage of steelmaking, Al content is specified to be more than or equal to 0.005%. Preferably, Al content is more than or equal to 0.010%. Furthermore, a preferred range of Al also depends on a relationship with Si. Similarly to Si, Al has an effect of inhibiting the precipitation of cementite, thereby increasing the stability of retained austenite. It is preferable that Si and Al be present in a total amount more than or equal to 0.90%. From the standpoint of inhibiting variations in mechanical properties, it is more preferable that Si and Al be present in a total amount more than or equal to 1.10%. On the other hand, Al is an element that reduces castability, and, therefore, from the standpoint of productivity, Al content is specified to be less than or equal to 0.70%. Preferably, Al content is less than or equal to 0.30%.

N: 0.0060% or Less

N is a harmful element that adversely affects stretch formability because N degrades room-temperature aging properties and causes unexpected cracking. Accordingly, it is desirable that N content be reduced as much as possible. In accordance with aspects of the present invention, N content is specified to be less than or equal to 0.0060%. Preferably, N content is less than or equal to 0.0050%. While it is desirable that N content be reduced as much as possible, N may be unintentionally incorporated in an amount of up to 0.0005% in the manufacturing.

The components described above are the basic components according to aspects of the present invention. The thin steel sheet according to aspects of the present invention has a chemical composition that contains the basic components described above, with the balance, other than the basic components described above, including Fe (iron) and incidental impurities. It is preferable that the thin steel sheet according to aspects of the present invention have a chemical composition that contains the basic components described above, with the balance being Fe and incidental impurities.

The chemical composition may further contain, in mass %, one or more of the following optional components: Ti: 0.001% or more and 0.2% or less, Nb: 0.001% or more and 0.2% or less, V: 0.001% or more and 0.5% or less, Cu: 0.001% or more and 0.5% or less, Ni: 0.01% or more and 0.5% or less, Cr: 0.001% or more and 1.0% or less, and B: 0.0002% or more and 0.0050% or less. These elements improve bendability by refining crystal grains, thereby inhibiting damage on a surface subjected to bending, or are austenite-stabilizing elements and, therefore, through the effect of TRIP, exert an effect on stretch formability. On the other hand, if these elements are present in an excessive amount, stretch formability is degraded as a result of formation of inclusions, or hardenability is excessively increased; therefore, a desired structure of the steel sheet is not achieved. Accordingly, the ranges mentioned above are specified.

Furthermore, the chemical composition may further contain, in addition to the above components, one or more of the following optional components: Mo: 0.001% or more and 1.0% or less, Sb: 0.001% or more and 0.050% or less, one or more REMs: 0.0002% or more and 0.050% or less, Mg: 0.0002% or more and 0.050% or less, and Ca: 0.0002% or more and 0.050% or less. These elements are elements that are used to adjust strength and control inclusions, for example. In instances in which these elements are present in amounts in the ranges mentioned above, the effects according to aspects of the present invention are not impaired.

Now, the microstructure of the thin steel sheet according to aspects of the present invention will be described. In the microstructure of the thin steel sheet according to aspects of the present invention, ferrite is present in an area fraction of 5% or more and 60% or less, as-quenched martensite is present in an area fraction of 10% or less (including 0%), retained austenite is present in an amount of 5% or more and 20% or less, and upper bainite, lower bainite, and tempered martensite are present in a total amount of more than 15% and less than 85%; and BCC iron that has a misorientation of 1° or less and surrounds retained austenite having an aspect ratio of 2.5 or higher is present in an area fraction of 5% or more and 70% or less, and a top 10% of retained austenite in terms of an equivalent circular diameter, of all retained austenite surrounded by BCC iron that has a misorientation of 1° or less, has an average aspect ratio of 2.5 or higher.

Ferrite is Present in Area Fraction of 5% or More and 60% or Less

Since a ferrite phase is soft, if an area fraction thereof is more than 60%, the desired strength of the steel sheet is not achieved. Accordingly, the area fraction of the ferrite phase is less than or equal to 60%. Preferably, the area fraction is less than or equal to 50%. On the other hand, if ferrite is present in an area fraction less than 5%, the effect of localization of C is lost, and as a result, desired retained austenite and BCC iron having small crystal structure disturbance is not obtained. Accordingly, the area fraction of the ferrite phase is specified to be more than or equal to 5%. Preferably, the area fraction is more than or equal to 12%. The ferrite phase according to aspects of the present invention is polygonal ferrite and is a constituent in which corrosion traces and second-phase constituents are not present in the grains.

As-Quenched Martensite is Present in Area Fraction of 10% or Less (Including 0%)

As-quenched martensite is very hard, and, in bending, grain boundaries thereof act as initiation sites for cracking near a surface; therefore, as-quenched martensite significantly reduces bendability. Achieving a bendability sought in accordance with aspects of the present invention requires ensuring that an area fraction of as-quenched martensite is less than or equal to 10%. Preferably, the area fraction is less than or equal to 8%. It is preferable that the area fraction of as-quenched martensite be as small as possible; the area fraction may be 0%.

Retained Austenite is Present in Amount of 5% or More and 20% or Less

Retained austenite improves stretch formability. Achieving the characteristics sought in accordance with aspects of the present invention requires the formation of retained austenite in an amount more than or equal to 5%. Preferably, the amount is more than or equal to 8%. On the other hand, retained austenite degrades delayed fracture characteristics, and, accordingly, the amount is specified to be less than or equal to 20%. Preferably, the amount is less than or equal to 17%.

Furthermore, when C concentration of the retained austenite is more than or equal to 0.6 mass %, the stability of the retained austenite associated with deformation is enhanced, and, therefore, El is increased. Accordingly, such C concentration is preferable. More preferably, C concentration of the retained austenite is more than or equal to 0.7 mass %. The upper limit of C concentration is not particularly limited. In many cases, C concentration is less than or equal to 1.2%.

Upper Bainite, Lower Bainite, and Tempered Martensite are Present in Total Amount of More than 15% and Less than 85%

The region other than those of the constituents described above is primarily formed of upper bainite, lower bainite, and tempered martensite. Achieving the desired strength and formability requires that a total amount thereof be more than 15% and less than 85%. It is desirable that the total amount be more than 30% and less than 80%.

BCC Iron that has Misorientation of 1° or Less and Surrounds Retained Austenite Having Aspect Ratio of 2.5 or Higher is Present in Area Fraction of 5% or More and 70% or Less Top 10% of Retained Austenite in Terms of Equivalent Circular Diameter, of All Retained Austenite Surrounded by BCC Iron that has Misorientation of 1° or Less, Has Average Aspect Ratio of 2.5 or Higher BCC iron having small crystal disturbance has high ductility and, therefore, improves stretch formability. On this basis, retained austenite having an aspect ratio of 2.5 or higher is to be surrounded by BCC iron that has misorientation of 1° or less. This is one of the features according to aspects of the present invention. As used herein, the term "surround" refers to, as determined by the method described in the Examples section, enclosing 70% or more of the outer periphery of the retained austenite having an aspect ratio of 2.5 or higher.

If the aspect ratio of the retained austenite is less than 2.5, bendability is reduced; that is, in punching, strain concentration occurs at interfaces between BCC iron and retained austenite, and as a result, voids form, and/or an adverse effect of the martensitic transformation of retained austenite appears. Accordingly, it is necessary to pay attention to retained austenite having an aspect ratio of 2.5% or more.

Furthermore, it is necessary that the BCC iron that surrounds the retained austenite have small crystal structure disturbance. If large disturbances are present, the ductility of the BCC iron itself is low, and in addition, during stretch forming, strain is not dispersed because the TRIP phenomenon progresses even with a low strain, and as a result, a desired stretch formability is not achieved. When the misorientation is less than or equal to 1°, an adverse effect as stated above does not appear. Accordingly, it is necessary to pay attention to BCC iron that has a misorientation of 1° or less. Note that the misorientation can be represented by a KAM value measured by the method described in the Examples section.

Achieving a desired stretch formability requires that the BCC iron that has a misorientation of 1° or less and surrounds retained austenite having an aspect ratio of 2.5 or more be present in an area fraction more than or equal to 5%. Preferably, the area fraction is more than or equal to 10%. On the other hand, if the area fraction is more than 70%, the desired strength of the steel sheet is not achieved. Accordingly, the area fraction is specified to be less than or equal to 70%. Preferably, the area fraction is less than or equal to 60%.

As described above, a cause of damage to a surface subjected to bending is strain concentration at interfaces between BCC iron and retained austenite, and the strain concentration tends to occur in coarse retained austenite. Accordingly, it is necessary to control the aspect ratio of the top 10% of retained austenite in terms of an equivalent circular diameter, of all retained austenite surrounded by BCC iron that has a misorientation of 1° or less. In the measurement of the aspect ratio, the target to be measured is the coarse retained austenite described above. Specifically, it is necessary to ensure that the average aspect ratio is higher than or equal to 2.5. Note that the "top 10% of retained austenite in terms of an equivalent circular diameter" is to be determined by the method described in the Examples section.

Note that when the BCC iron that has a misorientation of 1° or less and surrounds retained austenite having an aspect ratio of 2.5 or higher is present in an area fraction within the above-mentioned range, the total area fractions of the following (i) to (iii) are reduced to less than or equal to 80%, and as a result, the effects according to aspects of the present invention are produced. It is more preferable that the total amount of the following constituents (i) to (iii) be less than or equal to 65%.

(i) The area fraction of BCC iron that has a misorientation of 1° or less and surrounds retained austenite having an aspect ratio of less than 2.5

(ii) The area fraction of BCC iron that has a misorientation of more than 1° and surrounds retained austenite having an aspect ratio of 2.5 or higher (iii) The area fraction of BCC iron that has a misorientation of more than 1° and surrounds retained austenite having an aspect ratio of less than 2.5

The constituents of the remainder are not particularly limited. As long as the microstructure described above is achieved, the effects according to aspects of the invention are not impaired even if one or more other constituents coexist.

Now, a method for manufacturing the thin steel sheet according to aspects of the present invention will be described. The method for manufacturing the thin steel sheet according to aspects of the present invention is a method for manufacturing a thin steel sheet having the chemical composition described above. The manufacturing method includes a hot rolling step, a cold rolling step, and an annealing step. Furthermore, it is preferable that the manufacturing method according to aspects of the present invention include a heat treatment step that is performed after the cold rolling step and before the annealing step. Each of the steps will be described below.

The hot rolling step is a step of hot-rolling a steel starting material having the chemical composition described above.

Methods for manufacturing molten steel for the production of the steel starting material are not particularly limited;

any known method for manufacturing molten steel, such as a method using a converter, an electric furnace, or the like, may be employed. Furthermore, secondary refining may be carried out in a vacuum degassing furnace. Subsequently, a slab (steel starting material) may be formed by using a continuous casting method, which is preferable in terms of issues such as productivity and quality. Alternatively, the slab may be formed by using a known casting method such as an ingot casting-slabbing rolling method or a thin slab continuous casting method.

Hot rolling conditions for hot-rolling the steel starting material are not particularly limited and may be appropriately specified. For example, an after-hot-rolling coiling temperature may be preferably lower than or equal to 580° C., and more preferably, in terms of a shape of the coil for cold rolling, the coiling temperature may be specified to be lower than or equal to 530° C.

The cold rolling step is a step of performing pickling and cold rolling after the hot rolling step described above. In the cold rolling, it is necessary to enable recrystallization during annealing to be promoted to refine austenite and promote localization of C, thereby increasing the number of nucleation sites for transformation to promote the formation of BCC iron having little crystal strain; accordingly, a cold rolling reduction ratio needs to be more than or equal to 46%. Preferably, the cold rolling reduction ratio is more than or equal to 50%. The upper limit thereof is not specified but, in practice, is less than or equal to 75% because of a load of cold rolling. Conditions for the pickling are not particularly limited, and a known production method may be employed.

To achieve localization of carbon, which will be described later, a heat treatment step may be carried out after the cold rolling step and before the annealing step. The heat treatment step may include heating the cold-rolled steel sheet to 480° C. or higher and cooling the resulting steel sheet to room temperature. Regarding the heating, when a box annealing furnace is used, the heating is to be performed at 480° C. or higher and 680° C. or lower for 3 hours or more, and when a continuous annealing furnace is used, the heating is to be performed at 760° C. or higher and 820° C. or lower. When a box annealing furnace is used, if the temperature is not higher than or equal to 480° C., the localization of carbon is insufficient, and, therefore, performing box annealing provides limited advantage. On the other hand, if the temperature is higher than 680° C., austenite forms, which reduces the effect of localizing carbon, and, therefore, the temperature of 480° C. or higher and 680° C. or lower is specified. When continuous annealing is used, the heating time is shorter than the case that a box annealing furnace is used. Consequently, although austenite forms as a result of heating at 760° C., the effect of localizing carbon is produced. On the other hand, if the temperature is higher than 820° C., an amount of austenite that forms increases as with the box annealing furnace, and as a result, the C concentration of the austenite becomes lower; accordingly, a suitable temperature range in the case that continuous annealing is used is specified to be 760° C. or higher and 820° C. or lower. After the heating, it is more preferable to perform water cooling to freeze the state of localization of C.

The annealing step is a step that is performed as follows: after the cold rolling step or the heat treatment step, the resulting steel sheet is heated to a temperature of 780° C. or higher and 845° C. or lower; subsequently, the resulting steel sheet is cooled with an average cooling rate from 740° C. to 600° C. of 8° C./s or higher and 25° C./or less to a temperature of 400° C. or higher and 520° C. or lower; then, the resulting steel sheet is held at the temperature of 400° C. or higher and 520° C. or lower for 10 seconds or more and 80 seconds or less; then, the resulting steel sheet is cooled with an average cooling rate from 400° C. to 300° C. of 8° C./s or higher to a cooling stop temperature of 150° C. or higher and 300° C. or lower; then, the resulting steel sheet is held in a temperature range within ±50° C. of the cooling stop temperature for 2 seconds or more and 25 seconds or less; and thereafter, the resulting steel sheet is heated to a temperature of 300° C. or higher and 500° C. or lower and, subsequently, held in the temperature range for 480 seconds or more and 1400 seconds or less. Note that it is preferable that the annealing step be carried out in a continuous annealing line.

Heating to a Temperature of 780° C. or Higher and 845° C. or Lower

In the heating, it is necessary to form a ferrite phase by recrystallization and obtain an appropriate fraction of austenite. Achieving a desired area fraction of ferrite requires a heating temperature of higher than or equal to 780° C. Preferably, the heating temperature is higher than or equal to 790° C. On the other hand, if the heating temperature is higher than 845° C., the effect of localization of C is lost, and, therefore, in particular, retained austenite having a high aspect ratio cannot be obtained. Accordingly, the heating temperature is specified to be lower than or equal to 845° C. Preferably, the heating temperature is lower than or equal to 840° C.

Cooling with Average Cooling Rate from 740° C. to 600° C. of 8° C./s or Higher and 25° C./s or Less In the cooling after the heating, it is necessary to inhibit the formation of polygonal ferrite. If polygonal ferrite forms during the cooling, large crystal structure disturbances are caused, and retained austenite having a high aspect ratio cannot be obtained; consequently, bendability is reduced. From this standpoint, the average cooling rate from 740° C. to 600° C., which is a polygonal-ferrite-formation range, is specified to be higher than or equal to 8° C./s. Preferably, the average cooling rate is higher than or equal to 10° C./s. On the other hand, if the cooling rate is high, the localization of C is not effectively carried out. Accordingly, the upper limit of the cooling rate is specified to be 25° C./s or less. Preferably, the upper limit is 22° C./s or less.

Cooling to a Temperature Range of 400° C. or Higher and 520° C. or Lower

Inhibiting the formation of polygonal ferrite and forming BCC iron that has small crystal structure disturbance and surrounds retained austenite having a high aspect ratio require cooling to a temperature range of 400° C. or higher and 520° C. or lower, which is a temperature range for the formation of such BCC iron. If the temperature is lower than 400° C., the martensitic transformation progresses, which results in large crystal structure disturbances, and, therefore, the desired microstructure cannot be obtained. Accordingly, the cooling stop temperature is specified to be higher than or equal to 400° C. If the cooling stop temperature is higher than 520° C., the retained austenite has a reduced aspect ratio as a result of an influence of the formation of polygonal ferrite. Accordingly, the cooling stop temperature is specified to be lower than or equal to 520° C. Preferably, the cooling stop temperature is 420° C. or higher and 510° C. or lower.

Holding in Temperature Range of 400° C. or Higher and 520° C. or Lower for 10 Seconds or More and 80 Seconds or Less Subsequent to the cooling step described above, it is necessary to perform holding in a temperature range of 400°

C. or higher and 520° C. or lower for a specific period of time. With this holding, the formation of BCC iron that has small crystal structure disturbance and surrounds retained austenite having a high aspect ratio progresses effectively. If the holding temperature is lower than 400° C. or higher than 520° C., the desired microstructure cannot be obtained because of the formation of martensite or ferrite. Furthermore, if the holding time in the temperature range is less than 10 seconds, an area fraction of BCC iron that has small crystal structure disturbance and surrounds retained austenite having a high aspect ratio cannot be obtained, and, consequently, a desired stretch formability cannot be achieved. Accordingly, the holding time is specified to be more than or equal to 10 seconds. Preferably, the holding time is more than or equal to 20 seconds. On the other hand, if the holding time is more than 80 seconds, an excessive amount of BCC iron having small crystal structure disturbance forms, and, therefore, the desired strength of the steel sheet cannot be achieved. Accordingly, the holding time is specified to be less than or equal to 80 seconds. Preferably, the holding time is less than or equal to 60 seconds. It is sufficient that this holding be performed so as to ensure holding in the temperature range of 400° C. or higher and 520° C. or lower for a specific period of time; that is, the holding is not limited by thermal history associated with heating, cooling, isothermal holding, or the like.

Cooling with Average Cooling Rate from 400° C. to 300° C. of 8° C./s or Higher to Cooling Stop Temperature of 150° C. or Higher and 300° C. or Lower To freeze a microstructure that has been changed at a temperature higher than or equal to 400° C., it is necessary to perform cooling with an average cooling rate from 400° C. to 300° C. of 8° C./s or higher. If the average cooling rate is less than 8° C./s, BCC iron having small crystal structure disturbance forms in an excessive amount. Preferably, the average cooling rate is higher than or equal to 10° C./s. After the cooling, the cooling is stopped at a temperature of 150° C. or higher and 300° C. or lower. If the cooling stop temperature is lower than 150° C., austenite present in the steel sheet is transformed into martensite, and as a result, the desired amount of retained austenite cannot be obtained. Preferably, the cooling stop temperature is higher than or equal to 180° C. More preferably, the cooling stop temperature is higher than or equal to 200° C. On the other hand, if the cooling stop temperature is higher than 300° C., as-quenched martensite increases, and, consequently, bendability is degraded. Preferably, the cooling stop temperature is lower than or equal to 280° C., and more preferably, lower than or equal to 240° C.

Holding in Temperature Range within ±50° C. of Cooling Stop Temperature for 2 Seconds or More and 25 Seconds or Less A lower bainitic transformation progresses in a temperature range within ±50° C. of the cooling stop temperature. With the progress of the lower bainitic transformation, the C concentration of the retained austenite increases, and, consequently, stretch formability is further enhanced. Producing this effect requires that holding be performed for 2 seconds or more and 25 seconds or less from the point of time when the cooling is terminated at the cooling stop temperature of 150° C. or higher and 300° C. or lower, to the reheating, that is, the temperature range within ±50° C. of the cooling stop temperature. If the time period is less than 2 seconds, the progress of the lower bainitic transformation is insufficient, and, consequently, the desired effect is not produced. On the other hand, if the time period is more than 25 seconds, the effect no longer increases, and in addition, in the next step, an effect of reheating at a temperature of 300° C. or higher and 500° C. or lower exhibits variations, which results in significant variations in the material properties, in particular, strength. Preferably, the time period is 3 seconds or more and 20 seconds or less.

Heating to Temperature of 300° C. or Higher and 500° C. or Lower and Subsequent Holding in the Temperature Range for 480 Seconds or More and 1400 Seconds or Less Purposes are to concentrate C in the retained austenite, thereby ensuring that the retained austenite remains when the cooling to room temperature is carried out and to reduce the crystal structure disturbances of a constituent that forms at a low temperature. If the holding temperature is lower than 300° C., or the holding time is less than 480 seconds, the concentration in the retained austenite is not achieved, and, consequently, austenite, which is thermally unstable, is transformed into martensite when the cooling to room temperature is carried out. As a result, the desired amount of retained austenite cannot be obtained, and in addition, the amount of BCC iron having small crystal structure disturbance is reduced. On the other hand, if the holding temperature is higher than 500° C., or the holding time is more than 1400 seconds, cementite precipitates in the austenite, and as a result, the desired amount of retained austenite cannot be obtained. Accordingly, in the reheating step after the cooling to a temperature of 150° C. to 300° C. is carried out, holding is performed in the range of 300° C. or higher and 500° C. or lower for 480 seconds or more and 1400 seconds or less.

Examples

Steel sheets to be evaluated were each produced as follows. A steel starting material having the chemical composition shown in Table 1 and a thickness of 250 mm was subjected to hot rolling, pickling, and cold rolling; subsequently, the resulting steel sheet was annealed in a continuous annealing furnace under the conditions shown in Table 2; and subsequently, the resulting steel sheet was subjected to temper rolling, which was performed with an elongation rate of 0.2% to 0.4%. Some of the steel sheets were subjected to a heat treatment step, which was performed in a box annealing furnace or a continuous annealing furnace, before the cold rolling or before the final annealing step. The obtained thin steel sheets were evaluated by using the following procedures.

(i) Examination of Microstructure (Area Fractions of Microstructure)

A piece was cut from the steel sheet such that a cross section parallel to the rolling direction served as the surface to be examined. A sheet thickness middle portion was revealed by performing etching with 1% nital, and images of a sheet thickness ¼ depth position from a surface of the steel sheet (hereinafter referred to simply as "sheet thickness ¼ t portion") were captured for 10 fields of view by using a scanning electron microscope at a magnification of 2000×. Ferrite is a constituent having no observable corrosion traces or second-phase constituents in the grain. As-quenched martensite is a constituent that can be observed as a white region in SEM photographs, and retained austenite and cementite also have a similar morphology. In consideration of this, cementite was revealed by performing picral etching, and the area fraction of the cementite was determined. Furthermore, the sum of the area fraction of the as-quenched martensite, the area fraction of the cementite, and the area fraction of the retained austenite was determined from the SEM photographs. By subtracting, from the sum, the area fraction of the cementite and the area fraction of the retained austenite, which will be described later, were subtracted and the area fraction of the as-quenched martensite was determined. Upper bainite is a constituent having corrosion traces and a second-phase constituent that are recognizable in the grain, and tempered martensite and lower bainite are constituents having a lath structure and a fine second-phase constituent that are observable in the grains. The total amount of upper bainite, lower bainite, and tempered martensite constituents was determined as the sum of the area fractions of all of these.

For the measurement of BCC iron that surrounded retained austenite having an aspect ratio of 2.5 or higher, EBSD (electron beam backscattering diffraction) was used, and the measurement was conducted on the same cross section as that used in the SEM examination. Specifically, a region of $1\times10^3$ $\mu m^2$ or larger in the sheet thickness ¼ t portion were analyzed with a measurement step of 0.1 μm, by using OIM Analysis 6, available from TSL solutions K. K. From the analysis results, crystal structure disturbances were identified by using a KAM (Kernel average misorientation) method, and thus, BCC iron having a KAM value of 1° or less was identified. The aspect ratio of retained austenite was determined as follows. The maximum length and the minimum length of each of the target retained austenite grains were measured, and (maximum length)/(minimum length) was determined as the aspect ratio of each of the retained austenite grains.

For the measurement of the area fractions, an intercept method was used for both the SEM images and the EBSD images. In the obtained photographs, 20 horizontal lines and 20 vertical lines having an actual length of 30 μm were drawn such that a lattice pattern was formed. The constituent present at each of the intersection points was identified, and the area fraction of each of the constituents was determined as the ratio of the number of the intersection points having the constituent to the number of all the intersection points. In this instance, for each of the measurement points, BCC iron having a KAM value of 1° or less that contacts retained austenite having an aspect ratio of 2.5 or higher which does not straddle a high-angle grain boundary with a misorientation of 15° or more and does not straddle BCC iron having a KAM value of more than 1°, and BCC iron having a KAM value of 1° or less that surrounded retained austenite having an aspect ratio of 2.5 or higher in which 70% or more of the entire periphery thereof was surrounded by the BCC iron having a KAM value of 1° or less were identified as BCC iron that surrounds retained austenite having an aspect ratio of 2.5 or higher. According to this definition, BCC iron that conforms to the following (a) or (b) is outside the range of the definition, and only BCC iron that conforms to the following (c) is within the range of the definition.

(a) BCC iron in which a retained austenite having an aspect ratio of 2.5 or higher straddles a high-angle grain boundary with a misorientation of 15° or more and is in contact with two crystal grains of the BCC iron, and, in both of the two regions, the boundary between the BCC iron and the retained austenite having an aspect ratio of 2.5 or higher has a length more than 30% of the entire length of the periphery of the retained austenite having an aspect ratio of 2.5 or higher.

(b) BCC iron containing crystal grains of BCC iron that has a KAM value of 1° or more and is located adjacent to retained austenite having an aspect ratio of 2.5 or higher (c) BCC iron in which, although retained austenite having an aspect ratio of 2.5 or higher contacts two crystal grains of BCC iron and straddles a high-angle grain boundary with a misorientation of 150 or more, in one of the two regions, the boundary between the BCC iron and the retained austenite having an aspect ratio of 2.5 or higher has a length not more than 30% of the entire length of the periphery of the retained austenite having an aspect ratio of 2.5 or higher.

FIG. 1 is a schematic diagram illustrating (a) to (c), described above. Note that the calculation of the area fraction of the BCC iron that surrounded retained austenite having an aspect ratio of 2.5 or higher was performed as follows: a crystal grain of BCC iron enclosed by high-angle grain boundaries with misorientations of 15° or more, in which BCC iron that surrounded retained austenite having an aspect ratio of 2.5 or higher that satisfies the condition (c) above is present, was extracted, and the area fraction of the region was calculated and designated as the area fraction of BCC iron that surrounded retained austenite having an aspect ratio of 2.5 or higher.

In the measurement of the average aspect ratio, particular attention was paid to a top 10% of retained austenite in terms of an equivalent circular diameter. In this instance, the "top 10% of retained austenite in terms of an equivalent circular diameter" was determined in the following manner: an equivalent circular diameter of retained austenite grains present in regions having a KAM value of 1° or less was measured; from the results, the top 10% of retained austenite grains in terms of the grain diameter was extracted; and (major axis)/(minor axis) of each of the extracted retained austenite grains was measured, and an average of the results was calculated. The major axis and the minor axis can be determined by measuring the maximum distance and the minimum distance of the retained austenite.

(ii) Measurement of Fraction of Retained Austenite by XRD

The steel sheet was polished so as to reveal a sheet thickness ¼ position and was then chemically polished for another 0.1 mm. The resulting surface was analyzed with an X-ray diffractometer by using Mo-Kα radiation. Integrated intensities of reflection of the (200) plane, (220) plane, and (311) plane of the FCC iron (austenite) and the (200) plane, (211) plane, and (220) plane of the BCC iron (ferrite) were measured. From an intensity ratio, which is the ratio of the integrated intensities of reflection of the planes of the FCC iron (austenite) to the integrated intensities of reflection of the planes of the BCC iron (ferrite), a proportion of the austenite was determined and regarded as the fraction (area fraction) of the retained austenite.

The carbon concentration of the retained austenite was determined by using a lattice constant and equation (1). The lattice constant was determined from the peak angles of the (200) plane, (220) plane, and (311) plane of the austenite, which were measured with Cu-Ka radiation.

$$\text{C concentration of retained austenite} = 3.5780 + 0.0330[\%\ C] + 0.00095[\%\ Mn] + 0.0056[\%\ Al] + 0.0220[\%\ N] \quad (1)$$

Here, [% M] (M=C, Mn, Al, or N) is a concentration of the alloying element that is included.

A suitable range of the C concentration of the retained austenite as determined by the above procedure was specified to be 0.6% or more.

(iii) Tensile Test

A JIS No. 5 tensile test piece was cut from the obtained steel sheet in a direction perpendicular to the rolling direction. A tensile test in accordance with the specifications of JIS Z 2241 (2011) was conducted five times, and an average tensile strength (TS) and an average total elongation (El) were determined. For the tensile test, a crosshead speed of 10 mm/min was used. Regarding Table 3, a tensile strength of 590 MPa or higher and a product of TS and El of 17500 MPa-% or greater were specified as the mechanical properties of a steel sheet required in the steel according to aspects of the present invention.

Furthermore, good formability can be effectively achieved when necking and cracking are inhibited by dispersing strain when severe deformation is applied. In accordance with aspects of the present invention, when deformation is applied, BCC iron having small crystal structure disturbance is deformed first, and subsequently, BCC iron having larger crystal structure disturbance and retained austenite having a high aspect ratio present in BCC iron having small crystal structure disturbance are deformed; therefore, the stability of retained austenite against deformation is excellent. Hence, the steel sheet is suitable for use in automotive members, which are formed to have a complex shape. In accordance with aspects of the present invention, as a condition for inhibiting necking and cracking associated with severe deformation that involves bending-unbending, which is used, for example, in roll forming or the like, a suitable range of a value was specified to be 1.4 or larger, the value being defined as follows. On a true stress ($\sigma$)-true strain ($\varepsilon$) curve, the stability of retained austenite was represented by $d\sigma/d\varepsilon$ at 80% of $\varepsilon$ that satisfied the plastic instability condition ($d\sigma/d\varepsilon=0$), and the value was defined as the result of dividing $d\sigma/d\varepsilon$ mentioned above by the tensile strength.

(iv) Evaluation of Stretch Formability

Evaluation of stretch formability was conducted as follows. A sample was secured to a die having a diameter of 150 mm at a load of 100 tons, the sample was deformed by using a hemispherical punch having a radius of 75 mm, and a forming height at the time at which breakage occurred was evaluated. Forming heights sought in accordance with aspects of the present invention are as follows: 70 mm or higher when TS is 590 MPa or higher and less than 780 MPa; 60 mm or higher when TS is 780 MPa or higher and less than 980 MPa; 50 mm or higher when TS is 980 MPa or higher and less than 1180 MPa; and 43 mm or higher when TS is 1180 MPa or higher. In particular, for steel sheets having a tensile strength of 1180 MPa or higher, a preferable range was specified to be 45 mm or higher.

(v) Bending Test

To investigate bendability, a strip-shaped sample having a width of 100 mm and a length of 35 mm was cut, and, in accordance with JIS Z 2248, a bending test was conducted by using a V-block method with an apex angle of 90°; a minimum die radius (R) at which cracking did not occur was determined, and the minimum die radius (R) was divided by the sheet thickness (t) to determine a limit bending radius (R/t). A suitable range of the limit bending radius (R/t) was specified to be 2.0 or less.

It is apparent that in all of the Invention Examples, the tensile strength TS was 590 MPa or higher, and good formability was achieved. On the other hand, in Comparative Examples, which fell outside the range according to aspects of the present invention, the tensile strength was less than 590 MPa, or, the stretch formability and/or bendability sought in accordance with aspects of the present invention were not achieved.

TABLE 1

| Steel | Chemical composition (mass %) | | | | | | | | |
|---|---|---|---|---|---|---|---|---|---|
| No. | C | Si | Mn | P | S | Al | N | Others | Notes |
| A | 0.08 | 1.58 | 1.42 | 0.005 | 0.0004 | 0.02 | 0.0041 | — | Invention example |
| B | 0.11 | 1.48 | 1.86 | 0.010 | 0.0013 | 0.04 | 0.0026 | Ti: 0.02<br>B: 0.002 | Invention example |
| C | 0.12 | 1.50 | 2.72 | 0.007 | 0.0004 | 0.02 | 0.0029 | Mo: 0.06<br>V: 0.05<br>REM: 0.002 | Invention example |
| D | 0.19 | 1.44 | 2.57 | 0.009 | 0.0007 | 0.05 | 0.0034 | Ti: 0.02<br>Nb: 0.02<br>B: 0.002<br>Ca: 0.001 | Invention example |
| E | 0.11 | 0.98 | 2.53 | 0.012 | 0.0011 | 0.36 | 0.0037 | Cu: 0.1<br>Ni: 0.05<br>Cr: 0.05<br>Sb: 0.008 | Invention example |
| F | 0.22 | 1.53 | 2.32 | 0.008 | 0.0013 | 0.04 | 0.0031 | Mg: 0.008 | Invention example |
| G | 0.06 | 1.50 | 1.53 | 0.011 | 0.0011 | 0.02 | 0.0039 | — | Comparative example |
| H | 0.20 | 0.63 | 2.95 | 0.008 | 0.0006 | 0.03 | 0.0045 | — | Comparative example |
| I | 0.09 | 1.53 | 0.50 | 0.013 | 0.0010 | 0.03 | 0.0043 | — | Comparative example |
| J | 0.18 | 1.41 | 3.84 | 0.013 | 0.0008 | 0.05 | 0.0032 | — | Comparative example |

The underline indicates that the value is outside the range according to aspects of the present invention.

TABLE 2

| | | | | Heat treatment before final annealing | | | | | |
|---|---|---|---|---|---|---|---|---|---|
| Steel sheet No. | Steel No. | Surface | Cold rolling reduction ratio | Annealing furnace | Heating temperature (° C.) | Heating temperature (° C.) | Average cooling rate *1 (° C./s) | Cooling stop temperature*2 (° C.) | Holding time*3 (s) |
| 1 | A | CR | 50 | — | — | 838 | 21 | 424 | 54 |
| 2 | | CR | 50 | — | — | 764 | 20 | 453 | 33 |
| 3 | | CR | 57 | — | — | 825 | 3 | 455 | 52 |

TABLE 2-continued

| | | | | | | | | | |
|---|---|---|---|---|---|---|---|---|---|
| 4 | | CR | 56 | — | — | 835 | 21 | 564 | 35 |
| 5 | B | CR | 50 | — | — | 807 | 21 | 485 | 47 |
| 6 | | CR | 50 | — | — | 834 | 20 | 439 | 130 |
| 7 | | CR | 57 | — | — | 831 | 20 | 469 | 55 |
| 8 | C | CR | 57 | — | — | 829 | 21 | 477 | 49 |
| 9 | D | CR | 64 | — | — | 837 | 21 | 429 | 52 |
| 10 | | CR | 64 | BAF | 567 | 827 | 11 | 417 | 42 |
| 11 | | CR | 56 | CAL | 798 | 826 | 11 | 450 | 22 |
| 12 | | CR | 40 | — | — | 830 | 14 | 460 | 34 |
| 13 | | CR | 63 | — | — | 860 | 14 | 481 | 11 |
| 14 | | CR | 53 | — | — | 825 | 11 | 567 | 56 |
| 15 | | CR | 56 | — | — | 834 | 10 | 354 | — |
| 16 | | CR | 57 | — | — | 830 | 18 | 435 | 4 |
| 17 | | CR | 57 | — | — | 830 | 12 | 466 | 25 |
| 18 | | CR | 62 | — | — | 829 | 18 | 475 | 25 |
| 19 | | CR | 62 | — | — | 825 | 24 | 464 | 52 |
| 20 | E | CR | 62 | — | — | 831 | 12 | 471 | 43 |
| 21 | | CR | 57 | BAF | 515 | 836 | 22 | 456 | 55 |
| 22 | | CR | 43 | — | — | 835 | 20 | 482 | 50 |
| 23 | F | CR | 57 | — | — | 832 | 20 | 435 | 57 |
| 24 | | CR | 62 | CAL | 779 | 836 | 13 | 439 | 57 |
| 25 | G | CR | 57 | — | — | 835 | 16 | 489 | 34 |
| 26 | H | CR | 56 | — | — | 827 | 13 | 466 | 24 |
| 27 | I | CR | 50 | — | — | 830 | 10 | 463 | 28 |
| 28 | J | CR | 53 | — | — | 836 | 19 | 433 | 20 |
| 29 | D | CR | 50 | BAF | 520 | 805 | 16 | 445 | 29 |

| Steel sheet No. | Average cooling rate*4 (° C./s) | Cooling stop temperature*5 (° C.) | Holding time *6 (s) | Reheating temperature (° C.) | After-reheating holding time (s) | Notes |
|---|---|---|---|---|---|---|
| 1 | 18 | 217 | 15 | 398 | 1346 | Invention example |
| 2 | 22 | 213 | 20 | 420 | 1222 | Comparative example |
| 3 | 17 | 235 | 9 | 402 | 989 | Comparative example |
| 4 | 15 | 224 | 20 | 418 | 976 | Comparative example |
| 5 | 14 | 239 | 7 | 410 | 1379 | Invention example |
| 6 | 14 | 200 | 8 | 377 | 594 | Comparative example |
| 7 | 4 | 229 | 6 | 381 | 1120 | Comparative example |
| 8 | 14 | 239 | 12 | 372 | 506 | Invention example |
| 9 | 17 | 235 | 2 | 388 | 752 | Invention example |
| 10 | 19 | 238 | 11 | 376 | 1097 | Invention example |
| 11 | 20 | 216 | 16 | 381 | 1081 | Invention example |
| 12 | 25 | 201 | 19 | 419 | 863 | Comparative example |
| 13 | 16 | 216 | 8 | 394 | 1233 | Comparative example |
| 14 | 14 | 226 | 9 | 428 | 821 | Comparative example |
| 15 | — | 249 | 12 | 372 | 1387 | Comparative example |
| 16 | 22 | 229 | 19 | 385 | 1155 | Comparative example |
| 17 | 8 | 319 | 16 | 416 | 756 | Comparative example |
| 18 | 19 | 218 | 14 | 514 | 824 | Comparative example |
| 19 | 22 | 232 | 10 | 248 | 910 | Comparative example |
| 20 | 16 | 203 | 7 | 418 | 799 | Invention example |
| 21 | 15 | 229 | 15 | 426 | 1133 | Invention example |
| 22 | 14 | 223 | 12 | 414 | 821 | Comparative example |
| 23 | 23 | 237 | 13 | 414 | 555 | Invention example |
| 24 | 21 | 226 | 20 | 429 | 868 | Invention example |
| 25 | 10 | 213 | 11 | 424 | 700 | Comparative example |
| 26 | 21 | 237 | 12 | 420 | 1203 | Comparative example |
| 27 | 17 | 204 | 10 | 430 | 803 | Comparative example |
| 28 | 20 | 220 | 11 | 430 | 837 | Comparative example |
| 29 | 10 | 240 | 20 | 400 | 651 | Invention example |

*1: Average cooling rate from 740° C. to 600 C.

*2: Temperature when cooling from 740° C. was forcibly stopped

*3: Holding temperature in a range of 400° C. to 520° C.

*4: Average cooling rate from 400° C. to 300 C.

*5: Temperature when cooling from 400° C. was forcibly stopped

*6: Holding time at a temperature within ±50° C. of the temperature of *5

*For No. 15, the average cooling rate from 354° C. to 249° C. was 17° C./s.

The underline indicates that the value is outside the range according to aspects of the present invention.

TABLE 3

| Steel sheet No. | Microstructure: Area fraction of ferrite (%) | Area fraction of as-quenched martensite (%) | Area fraction of BCC iron with 1° or less*1 (%) | Aspect ratio of retained austenite in BCC iron*2 | Retained austenite (%) | C concentration of retained austenite (mass %) | Total amount of upper bainite, lower bainite, and tempered martensite (%) |
|---|---|---|---|---|---|---|---|
| 1 | 45 | 4 | 40 | 3.7 | 8 | 0.8 | 41 |
| 2 | 70 | 8 | 12 | 4.1 | 8 | 0.8 | 14 |
| 3 | 77 | 14 | 3 | 1.8 | 5 | 0.8 | 4 |
| 4 | 89 | 9 | 1 | 1.2 | 1 | 0.3 | 0 |
| 5 | 25 | 6 | 53 | 3.0 | 9 | 0.6 | 59 |
| 6 | 18 | 3 | 76 | 3.1 | 11 | 0.8 | 66 |
| 7 | 15 | 4 | 73 | 4.3 | 12 | 0.6 | 68 |
| 8 | 20 | 3 | 45 | 4.2 | 11 | 0.7 | 64 |
| 9 | 14 | 3 | 40 | 4.3 | 11 | 0.6 | 72 |
| 10 | 12 | 8 | 39 | 4.4 | 11 | 0.8 | 69 |
| 11 | 13 | 6 | 39 | 4.0 | 12 | 0.8 | 68 |
| 12 | 11 | 11 | 2 | 4.1 | 12 | 0.7 | 68 |
| 13 | 0 | 3 | 23 | 1.4 | 11 | 0.5 | 86 |
| 14 | 29 | 24 | 3 | 3.7 | 12 | 0.8 | 35 |
| 15 | 12 | 8 | 0 | — | 10 | 0.4 | 68 |
| 16 | 12 | 6 | 2 | 3.5 | 12 | 0.9 | 70 |
| 17 | 10 | 14 | 33 | 3.8 | 12 | 0.6 | 63 |
| 18 | 13 | 6 | 54 | 3.5 | 3 | 0.9 | 78 |
| 19 | 11 | 14 | 36 | 3.1 | 4 | 0.8 | 69 |
| 20 | 15 | 8 | 47 | 4.1 | 10 | 0.8 | 65 |
| 21 | 16 | 3 | 46 | 3.1 | 11 | 0.9 | 69 |
| 22 | 14 | 12 | 3 | 2.2 | 8 | 0.4 | 98 |
| 23 | 13 | 7 | 39 | 4.1 | 11 | 0.5 | 67 |
| 24 | 12 | 5 | 42 | 3.8 | 12 | 0.7 | 71 |
| 25 | 70 | 8 | 0 | — | 3 | 0.2 | 19 |
| 26 | 10 | 7 | 78 | 4.1 | 3 | 0.4 | 78 |
| 27 | 85 | 10 | 0 | 4.3 | 1 | 0.2 | 3 |
| 28 | 0 | 12 | 0 | — | 8 | 0.8 | 80 |
| 29 | 6 | 7 | 13 | 3.2 | 14 | 0.9 | 73 |

| Steel sheet No. | Tensile strength (MPa) | Total elongation (%) | (dσ/dε)/TS | TS × EI | Bendability | Stretch formability | Notes |
|---|---|---|---|---|---|---|---|
| 1 | 624 | 38 | 1.5 | 23560 | 0.5 | 73 | Invention example |
| 2 | 566 | 42 | 1.4 | 23560 | 0.5 | 78 | Comparative example |
| 3 | 539 | 44 | 1.2 | 23560 | 0.5 | 69 | Comparative example |
| 4 | 491 | 48 | 1.2 | 23560 | 0.0 | 68 | Comparative example |
| 5 | 797 | 30 | 1.6 | 23560 | 1.0 | 63 | Invention example |
| 6 | 566 | 42 | 1.5 | 23560 | 0.5 | 81 | Comparative example |
| 7 | 574 | 41 | 1.5 | 23560 | 0.5 | 83 | Comparative example |
| 8 | 1014 | 21 | 1.5 | 21560 | 1.5 | 52 | Invention example |
| 9 | 1212 | 16 | 1.5 | 19392 | 1.5 | 43 | Invention example |
| 10 | 1228 | 19 | 1.5 | 23332 | 1.5 | 49 | Invention example |
| 11 | 1240 | 18 | 1.4 | 21960 | 1.5 | 47 | Invention example |
| 12 | 1190 | 14 | 1.2 | 16660 | 2.5 | 41 | Comparative example |
| 13 | 1216 | 16 | 1.3 | 19456 | 2.9 | 43 | Comparative example |
| 14 | 1236 | 18 | 1.3 | 22248 | 2.9 | 48 | Comparative example |
| 15 | 1195 | 14 | 1.2 | 16730 | 2.5 | 40 | Comparative example |
| 16 | 1232 | 15 | 1.3 | 18480 | 2.7 | 41 | Comparative example |
| 17 | 1205 | 20 | 1.7 | 23560 | 2.7 | 50 | Comparative example |
| 18 | 1155 | 15 | 1.2 | 17325 | 2.5 | 42 | Comparative example |
| 19 | 1288 | 12 | 1.2 | 15456 | 2.7 | 39 | Comparative example |
| 20 | 1020 | 18 | 1.6 | 18360 | 1.5 | 45 | Invention example |
| 21 | 1021 | 21 | 1.5 | 21560 | 1.5 | 52 | Invention example |
| 22 | 1052 | 14 | 1.2 | 14728 | 2.5 | 41 | Comparative example |
| 23 | 1197 | 15 | 1.7 | 17955 | 2.0 | 44 | Invention example |
| 24 | 1234 | 18 | 1.6 | 21960 | 1.7 | 47 | Invention example |
| 25 | 576 | 41 | 1.3 | 23560 | 0.5 | 77 | Comparative example |
| 26 | 1209 | 13 | 1.5 | 15717 | 2.2 | 41 | Comparative example |

TABLE 3-continued

| | | | | | | | |
|---|---|---|---|---|---|---|---|
| 27 | 496 | 48 | 1.2 | 23560 | 0.5 | 86 | Comparative example |
| 28 | 1292 | 13 | 1.3 | 16796 | 2.9 | 40 | Comparative example |
| 29 | 1199 | 19 | 1.5 | 22781 | 1.5 | 45 | Invention example |

*1: BCC iron having a KAM value of 1° or less and surrounds retained austenite having an aspect ratio of 2.5 or higher

*2: Average aspect ratios of top 10% of austenite in terms of equivalent circular diameter, of all austenite surrounded by BCC iron having KAM value of 1° or less The underline indicates that the value is outside the range according to aspects of the present invention.

The invention claimed is:

1. A steel sheet comprising:

a chemical composition containing, in mass %,

C: 0.08% or more and 0.24% or less;

Si: 0.70% or more and 2.20% or less;

Mn: 0.8% or more and 1.86% or less;

P: 0.05% or less;

S: 0.005% or less;

Al: 0.005% or more and 0.70% or less; and

N: 0.0060% or less, the balance being Fe and incidental impurities; and a microstructure including ferrite in an area fraction of 5% or more and 60% or less, as-quenched martensite in an area fraction of 10% or less (including 0%), retained austenite in an area fraction of 5% or more and 20% or less, and upper bainite, lower bainite, and tempered martensite in a total area fraction of more than 15% and less than 85%, wherein:

BCC iron having a misorientation of 1° or less and surrounds retained austenite having an aspect ratio of 2.5 or higher is present in an area fraction of 5% or more and 70% or less; and a top 10% of retained austenite in terms of an equivalent circular diameter, of all retained austenite surrounded by BCC iron having a misorientation of 1° or less, has an average aspect ratio of 2.5 or higher.

2. The steel sheet according to claim 1, wherein the chemical composition further contains, at least one selected from the following groups A and B consisting of:

Group A: in mass %, one or more of:

Ti: 0.001% or more and 0.2% or less;

Nb: 0.001% or more and 0.2% or less;

V: 0.001% or more and 0.5% or less;

Cu: 0.001% or more and 0.5% or less;

Ni: 0.01% or more and 0.5% or less;

Cr: 0.001% or more and 1.0% or less; and

B: 0.0002% or more and 0.0050% or less; and

Group B: in mass %, one or more of:

Mo: 0.001% or more and 1.0% or less;

Sb: 0.001% or more and 0.050% or less;

REM: 0.0002% or more and 0.050% or less;

Mg: 0.0002% or more and 0.050% or less; and

Ca: 0.0002% or more and 0.050% or less.

3. A method for manufacturing the steel sheet according to claim 1, comprising:

cold rolling a hot-rolled steel sheet having the chemical composition according to claim 1 with a rolling reduction ratio of 46% or higher; and annealing the cold-rolled steel sheet including, after the cold rolling: , heating the cold-rolled steel sheet to a temperature of 780° C. or higher and 845° C. or lower;

cooling the cold-rolled steel sheet with an average cooling rate from 740° C. to 600° C. of 8° C./s or higher and 25° C./s or less to a temperature range of 400° C. or higher and 520° C. or lower;

holding the cold-rolled steel sheet at the temperature range of 400° C. or higher and 520° C. or lower for 10 seconds or more and 80 seconds or less;

cooling the cold-rolled steel sheet with an average cooling rate from 400° C. to 300° C. of 8° C./s or higher to a cooling stop temperature of 150° C. or higher and 300° C. or lower;

holding the cold-rolled steel sheet in a temperature range within ±50° C. of the cooling stop temperature for 2 seconds or more and 25 seconds or less; and heating the cold-rolled steel sheet to a temperature range of 300° C. or higher and 500° C. or lower and, subsequently, holding the cold-rolled steel sheet in the temperature range of 300° C. or higher and 500° C. or lower for 480 seconds or more and 1400 seconds or less.

4. A method for manufacturing the steel sheet according to claim 2, comprising:

cold rolling a hot-rolled steel sheet having the chemical composition according to claim 2 with a rolling reduction ratio of 46% or higher; and annealing the cold-rolled steel sheet including, after the cold rolling: , heating the cold-rolled steel sheet to a temperature of 780° C. or higher and 845° C. or lower;

cooling the cold-rolled steel sheet with an average cooling rate from 740° C. to 600° C. of 8° C./s or higher and 25° C./s or less to a temperature range of 400° C. or higher and 520° C. or lower;

holding the cold-rolled steel sheet at the temperature range of 400° C. or higher and 520° C. or lower for 10 seconds or more and 80 seconds or less;

cooling the cold-rolled steel sheet with an average cooling rate from 400° C. to 300° C. of 8° C./s or higher to a cooling stop temperature of 150° C. or higher and 300° C. or lower;

holding the cold-rolled steel sheet in a temperature range within ±50° C. of the cooling stop temperature for 2 seconds or more and 25 seconds or less; and heating the cold-rolled steel sheet to a temperature range of 300° C. or higher and 500° C. or lower and, subsequently, holding the cold-rolled steel sheet in the temperature range of 300° C. or higher and 500° C. or lower for 480 seconds or more and 1400 seconds or less.

* * * * *